US006030298A

United States Patent [19]

Tate

[11] Patent Number: 6,030,298

[45] Date of Patent: Feb. 29, 2000

[54] DIVOT TOOL WITH BALL MARKER AND BRUSH

[76] Inventor: John R. Tate, 11621 Markon Dr., Garden Grove, Calif. 92841

[21] Appl. No.: 09/283,861

[22] Filed: Apr. 1, 1999

[51] Int. Cl.[7] ..... A63B 57/00

[52] U.S. Cl. ..... 473/408

[58] Field of Search ..... 473/408, 286; D21/793, 795

[56] References Cited

U.S. PATENT DOCUMENTS

| | | | |
|---|---|---|---|
| D. 353,645 | 12/1994 | Robidoux et al. | D21/793 |
| 3,415,518 | 12/1968 | Root | 473/408 |
| 4,151,937 | 5/1979 | Jarosh et al. | 473/408 |
| 5,022,650 | 6/1991 | Madock | 473/408 |
| 5,054,777 | 10/1991 | Borden et al. | 473/408 |
| 5,388,824 | 2/1995 | Reimers | 473/408 |
| 5,419,551 | 5/1995 | Hoyt et al. | 473/408 |

*Primary Examiner*—Steven Wong
*Attorney, Agent, or Firm*—Charles H. Thomas

[57] ABSTRACT

A golf surface repair tool having a pair of legs for repairing a golfing surface following a shot is provided with internal implements that may be utilized as well. Specifically, the golf surface repair tool is fabricated utilizing at least three releasably interengageable body members. The legs of the repair tool extend from the first body member, which also defines an open mouth and a hollow cavity therewithin at its opposite end. The second body member has a closed end and an opposing open mouth and also defines at least one hollow cavity therewithin. A third body member is formed with a central base and a pair of pedestals which project from the base in opposite directions from each other. The pedestals have sides that respectively fit snugly in frictional or other engagement into the open mouths of the first and second body members. One or more writing implements, such as a marking pen for marking golf balls and/or a lead pencil for writing golf scores on a score card, are mounted to one of the pedestals projecting out from the central base. A brush is mounted to the other pedestal and projects in a direction opposite the writing implements. The brush and the writing implements are thereby enclosed within the hollow cavities of the first and second body members when the pedestals of the third body member are engaged with the first and second body members.

19 Claims, 7 Drawing Sheets

DIVOT TOOL WITH BALL MARKER AND BRUSH

BACKGROUND OF THE INVENTION

1. Field of the Invention

The present invention relates to a golf accessory useful as a golf playing surface repair tool and which houses a marking pen for placing identifying marks on golf balls, a pencil for filling out golf score cards, and a brush for removing dirt from golf cleats.

2. Description of the Prior Art

Divot or golf surface repair tools have been available for use by golfers for many years. Conventional divot tools are often formed of metal and are configured to include a body portion from which a pair of elongated legs extend in generally mutually parallel arrangement. A golfer utilizes such a divot repair tool by holding one end of the tool and inserting the legs located at the opposite end of the tool into a golf surface, either a fairway or a green, in order to spruce up the surface following a shot in the game of golf.

Throughout the years golf divot tools have been devised which incorporate other features or accessories which are useful to golfers. For example, U.S. Pat. No. 4,627,621 discloses a golf accessory tool which serves both as a divot tool and as a money clip. U.S. Pat. Nos. 5,294,683 and 5,305,999 depict and describe golf divot tools which provide seating recesses to receive golf ball markers. Such markers are typically fabricated as small, disc-shaped structures, sometimes bearing a surface ornamentation, that are placed upon the field of play to mark the position of a golf ball until the golfer's next shot. Other divot repair tools provide cradles that are located on the end of the tool remote from the divot tool legs so as to support the handle of a golf club, thereby holding the handle of the club off of the grass playing surface. Still other divot tools are configured to form golf cleat or spike cleaners and other implements useful in the game of golf.

SUMMARY OF THE INVENTION

Prior to the present invention it has not occurred to anyone that a golf ball marking pen could be incorporated into the structure of a golf surface repair tool. Golfers frequently use marking pens to place small, identifying indicia on their golf balls so that the golf balls of different players can be positively distinguished from each other when on the field of play. However, until the present invention it has been necessary for a golfer to remember to carry a marking pen, such as a brightly colored felt-tip marker, in the golfer's golf bag or in the golfer's pocket. Quite often the caps for such marking pens can become dislodged or misplaced. When this occurs the tip of the marking pen is exposed continuously, thus leading to untended stains on the golfer's hands, clothing, and golf bag. Also, a golfer is often apt to forget to bring a conventional marking pen onto the field of play for purpose of placing identifying indicia on the golf balls used during the round of golf. The golfer is then forced to borrow a marking pen from some other player in the group, provided that at least one player in the group has remembered to bring a marking pen.

The present invention provides a convenient and unique way for equipping a golfer with a ball marking pen in such a manner that the golfer is not likely to forget or misplace the ball marking pen and in a manner in which the clothing and skin of the golfer are unlikely to be exposed to accidental contact with the tip of the ball marking pen.

According to the present invention a ball marking pen, such as a felt-tip pen, is combined with the structure of a golf surface repair tool in such a manner that the tip of the marking pen is enclosed within the structure of the golf surface repair tool so as to prevent accidental contact between the pen tip and the clothing or skin of the user. Nevertheless, the marking pen is readily available for use in placing identifying indicia on a golf ball when the occasion arises. Moreover, the structure of the device of the invention is configured as, and is always available for use as, a golf surface repair tool.

It has also not previously occurred to anyone that a pencil for filling out golf scores on a golf card could likewise be incorporated into the structure of a golf surface repair tool. Golfer's frequently carry with them small, hard lead pencils with which they fill out their scores on their golf score card as each hole is completed. However, until the present invention, such pencils have typically been carried loose in the pockets of the golfer's slacks or in a golf bag. Quite often the golfer misplaces the pencil and winds up fumbling through his or her pockets or through the pockets of a golf bag in order to locate it.

The present invention provides a very organized way for carrying a lead pencil in a manner such that the golfer can readily locate it at the conclusion of each hole. This is because the pencil is reduced to a very small size and mounted within the enclosure of a hollow golf divot repair tool. By carrying the pencil in this manner, the golfer avoids inadvertent breaking off of the pencil tip and ensures that the pencil can be immediately located when required.

It has also not previously occurred to anyone that a brush for cleaning the golf spikes of golf shoes could likewise be incorporated into and housed within the structure of a golf surface repair tool. Golf cleat brushes are frequently employed to remove dirt, matted grass, and occasionally other debris from a golfer's shoes. Typically a golfer will carry an old toothbrush, or some other implement of this type, in a golf bag for this purpose. Often, however, the brush is carried in the pocket of a golf bag along with golf balls, golf tees, towels, or other articles. The bristles of the brush become dirty with use and dirt is therefore often transferred from the bristles of the brush to golf balls, tees, towels, or other articles that the golfer carries while playing the course. By incorporating a brush within a golf surface repair tool, the bristles of the brush are isolated from contact with other golfing accessories. Also, the golfer can readily locate the brush since it is mounted on a component element of the golf surface repair tool. The convenient storage and easy accessibility of golf brush in this manner provides an added advantage to the utilization of the present intention.

In one broad aspect the present invention may be considered to be a golf surface repair tool having a body from which a pair of legs extend in side-by-side relationship wherein the body is comprised of at least three component elements which are releasably engageable together to define at least two enclosures therewithin. These component elements are also separable from each other. The invention is further comprised of a writing implement and a brush mounted within the body so as to fit into at least two enclosures when the component elements are releasably engaged together. The writing implement and the brush are selectively exposed for use when selected ones of the component elements are separated from each other.

In a preferred embodiment of the invention, a pair of writing implements are mounted to one or more of the component elements of the invention and are housed within the enclosures defined therewithin. One of these writing implements may include a marking pen for placing marks on golf balls, while the other writing implement may include a hard pencil lead for writing golf scores on golf score cards. Both of the writing implements are greatly reduced in size from the conventional writing implements employed for these purposes. Despite their small size, however, the writing implements are not likely to become lost since they are secured to the body of the golf surface repair tool and are housed within the confines of the golf surface repair tool when the body components thereof are assembled together. The writing implements are preferably mounted side by side to one of the body components of the golf surface repair tool of the invention, typically by means of small sockets in one of the body components.

Additional features may also be incorporated into the device of the invention. For example, one of the body components may have an end configured with a concave club rest having opposing ends. Also, the golf surface repair tool may be formed with a circular recess in its outer surface within which a magnet or magnetic material is positioned and secured. The circular recess serves as a seat for a golf ball marker. Such ball markers are typically formed of steel, so that they are held in place in the ball marker seat defined on the surface of the repair tool by the force of magnetism.

In addition, a very short pencil structure including a pencil lead may be embedded in one of the body components within the structure of the golf surface repair tool. The pencil lead is preferably a hard lead unlikely to break off while writing or become dull over the length of the course. The golfer is thereby provided with a pencil in a holder that forms a portion of the golf surface repair tool of the invention. Golfers typically use pencils to write their golf scores for each hole on a score card, and to initial the score cards of others.

The same body component bearing the pencil lead and the ink tip ball marking implement may also be configured to carry a golf cleat brush at its end opposite the end at which the pencil lead and ball marking implement are mounted. The cleat cleaner brush preferably has a plurality of sets of bristles embedded in the same component of the tool in which the ink tip ball marker and pencil are mounted, but at the opposite end of that body component and projecting in the opposite direction. The cleat cleaning brush, when exposed, may be inserted into spaces between the golf cleats or spikes to dislodge dirt, matted grass clippings, and other debris therefrom.

The body components of the golf surface repair tool of the invention may be configured to define indentations to receive fingernails and shallow thumb or finger tip-receiving depressions. These indentations and depressions provide grips for the fingernails, thumb, and fingers of a golfer's hands to facilitate separation of the body components of the tool. The finger tip or thumb tip depressions provide convenient and comfortable grips with which to hold one or both ends of the golf surface repair tool. The fingernail indentations and the shallow depressions are configured in such a manner as to facilitate separation of the tool body components.

In another broad aspect the invention may be considered to be golf surface repair tool formed of at least three body members, namely first, second, and third body members. The first body member has a pair of legs and an open mouth and defines a hollow cavity therewithin that is in communication with its open mouth. The second body member has a closed end and an opposing open mouth and defines at least one hollow cavity in open communication with its open mouth. The third body member is formed with a central base and first and second pedestals that project from the base in opposite directions from each other. The pedestals have sides that respectively fit snugly into frictional engagement into the open mouths of the first and second body members. One or more writing implements are mounted to one of the first and second pedestals and project away from the central base. A brush is mounted to the other of the first and second pedestals and projects away from the central base in a direction opposite the writing implement. In this way the brush and writing implement are enclosed within the hollow cavities of the first and second body members when the pedestals of the third body member are frictionally engaged therewith.

In still another broad aspect the invention may be considered to be a golf surface repair tool formed of a plurality of detachable and releasably engageable body components. A first body component has one end at which a pair of legs that define a gap therebetween are formed, and opposite end that forms an open cavity within the first body component. A second body component has a closed end and an opposite end defining at least one open cavity therewithin. A third body component is formed with a central base and a pair of pedestals projecting in opposite directions from the central base. The pedestals are smaller in cross-sectional area than the central base. This construction forms seating ledges beside both of the pedestals and within the perimeter of the central base. At least one writing implement is mounted in one of the pedestals and projects outwardly away from the base. A brush is mounted in the other of the pedestals and has bristles projecting outwardly therefrom away from the base in a direction opposite the writing implement. The first and second body components are releasably engageable with the third body component so that the opposite ends of the first and second body components reside in abutment against the seating ledges of the third body component, thereby closing the cavities. The opposite ends of the first and second body components are engaged by friction with the pedestals so that the at least one writing implement and the brush project into and are house within the cavities in respective ones of the first and second body components.

To utilize the writing implements, the second body member is separated from the third body member, while the first and third body members remain engaged together. Conversely, the brush is exposed for use by separating the first body member from the third body member while the second and third body members remain coupled together. Separation is facilitated by the formation of fingernail grip indentations and fingertip depressions in the body members. A disc-shaped ball marker may be removably mounted in the golf surface repair tool as well. The ball marker may be held in position by a magnet in the tool.

The invention may be described with greater clarity and particularity by reference to the accompanying drawings.

DESCRIPTION OF THE EMBODIMENT

Figure 1:
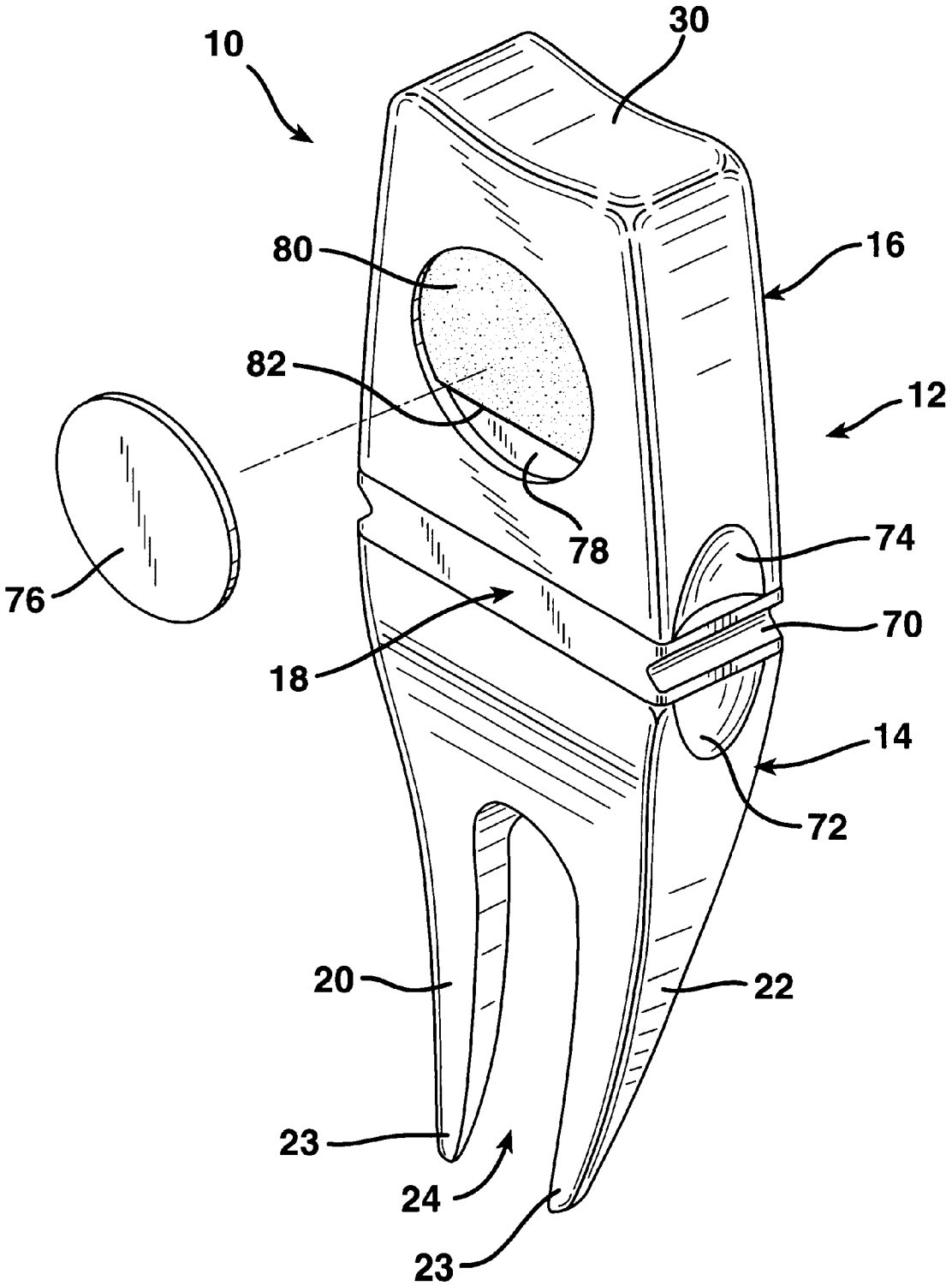
FIG. 1 is a perspective view of one preferred embodiment of a golf surface repair tool according to the invention.
Figure 2:
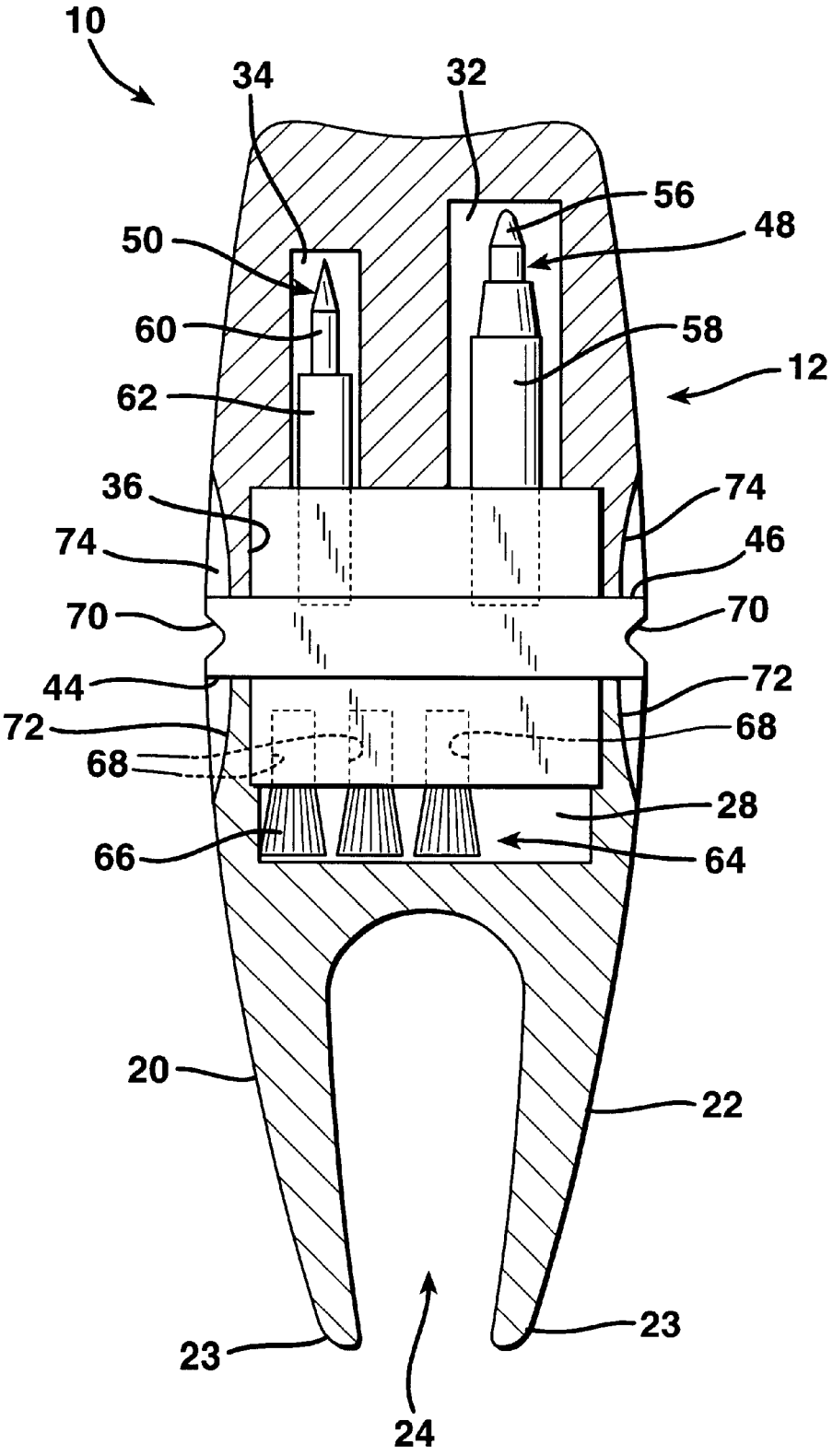
FIG. 2 is a front sectional elevational view of the golf surface repair tool of FIG. 1.
Figure 4:
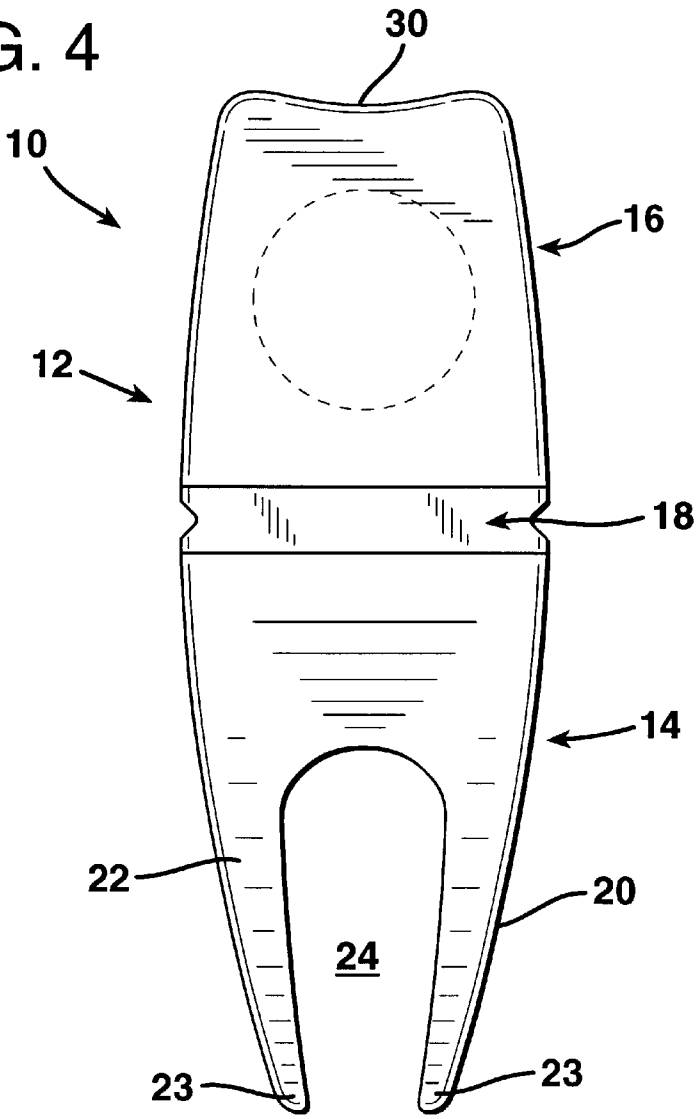
FIG. 4 is a rear elevational view of the golf surface repair tool of FIG. 1.
Figure 5:
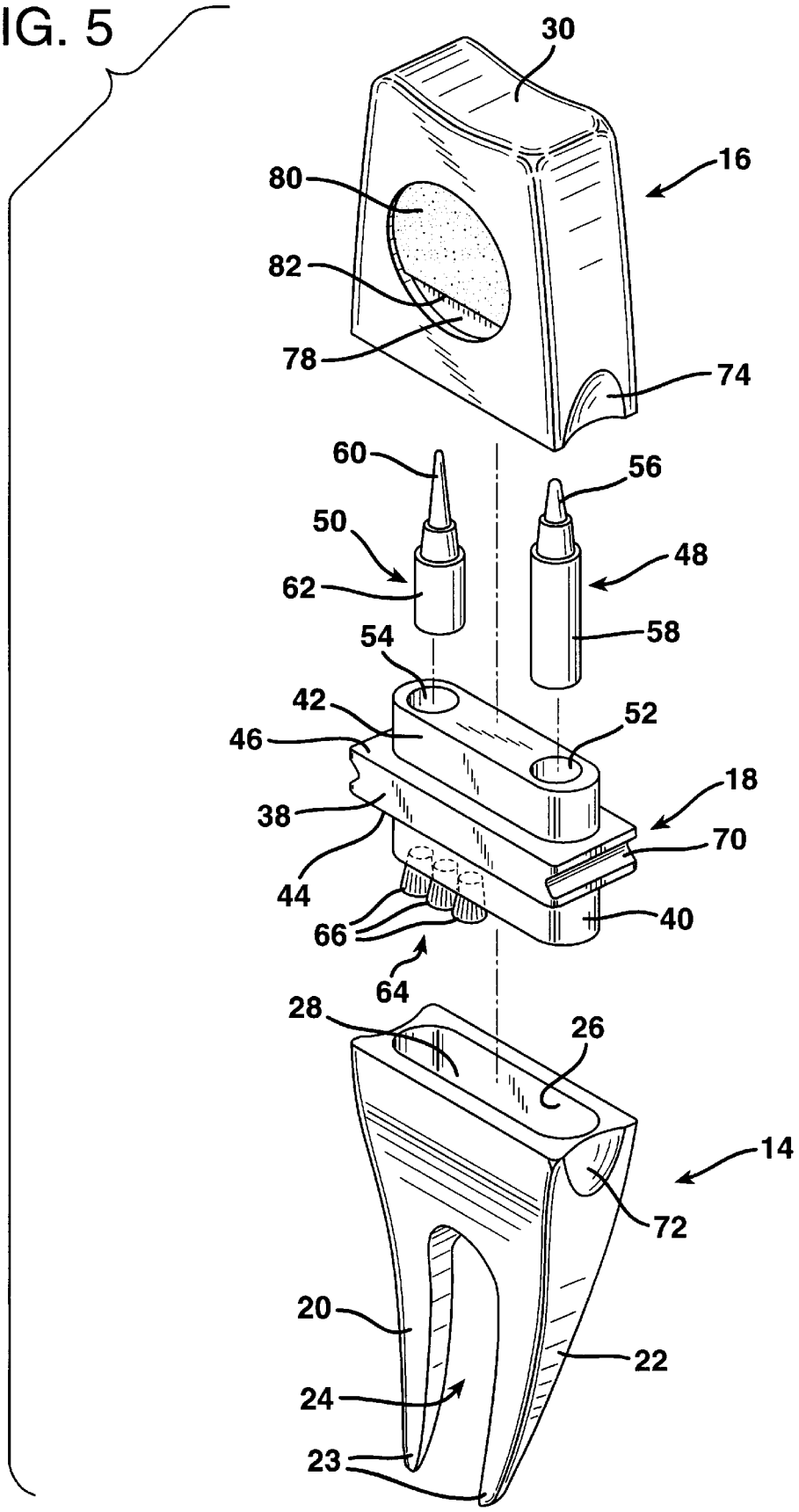
FIG. 5 is an exploded perspective view of the golf surface repair tool of FIG. 1 shown to illustrate separation of all of the body components, and of the writing implements.

FIGS. 1–7 illustrate a golf surface repair tool indicated generally at 10 of the type utilized to repair fairway divots and spruce up golf greens. The golf surface repair tool 10 is preferably about 3.25 inches long, about one inch in width, and about 0.5 inches in thickness. The golf divot repair tool 10 includes a body 12 formed of three separable body component elements 14, 16, and 18. The body components 14, 16, and 18 are releasably engageable with each other, as depicted in FIG. 2, and are also detachable from each other, as illustrated in FIG. 5. All of the body component elements 14, 16, and 18 are preferably formed as molded, plastic structures.

Figure 3:
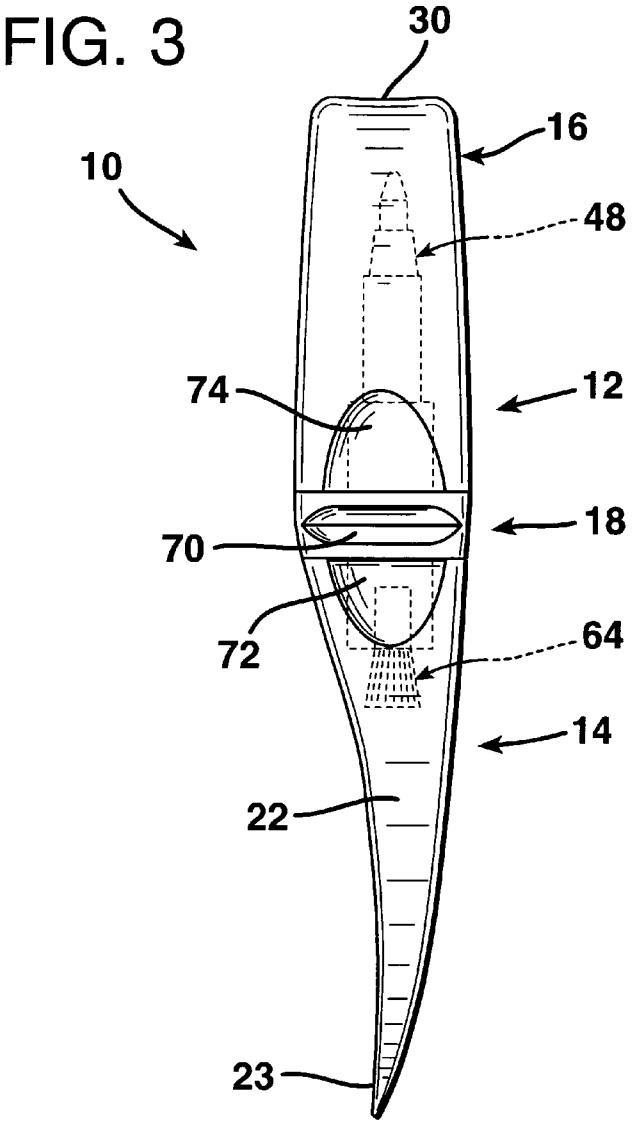
FIG. 3 is a right-side elevational view of the golf surface repair tool of FIG. 1.

The first body component 14 has one end at which a pair of legs 20 and 22 are formed. The legs 20 and 22 are located side by side and define a gap 24 therebetween. The legs 20 and 22 preferably have distal extremities 23 that progressively narrow toward their tips and which are arcuately curved, as best illustrated in FIG. 3. At its end, opposite the end at which the legs 20 and 22 are formed, the first body component 14 has an open mouth 26 and forms a hollow cavity 28 that is in open communication with its mouth 26. The mouth 26 has a laterally elongated oblong configuration, rounded at both ends, and is defined within the wall structure of the upper end of the first body component 14.

The second body component 16 has an upper, closed end 30 the upper surface of which is concave. The curved top surface of the closed, upper end 30 serves as a golf club shaft rest. At its opposite, lower end the second body component or member 16 defines a pair of hollow, cylindrical cavities 32 and 34 and an open mouth 36. The mouth 36 is formed by and within the wall structure of the lower end of the second body member 16. The mouth 36 also has a laterally elongated, oblong configuration rounded at both ends.

The third body member 18 is formed with a central base 38 and first and second pedestals 40 and 42, respectively, that project from the base 38 in opposite directions from each other. The pedestals 40 and 42 are both smaller in cross-sectional area than the central base 38 and are located entirely within the area encompassed by the central base 38. Seating ledges 44 and 46 are thereby formed beside both of the pedestals 40 and 42, respectively, and within the perimeter of the base 38. The pedestals 40 and 42 have smooth sides of a uniform outer cross section throughout that fit snugly into frictional engagement into the open mouths 26 and 36 of the first and second body members 14 and 16, respectively. The outer cross section of the pedestal 40 is uniform throughout its length. The walls of the pedestal 40 fit snugly within the encompassing confines of the encircling walls of the upper end of the first body member 14 that define the upwardly opening mouth 26 thereof. The pedestal 40 thereby slides smoothly into the mouth 26 and resides coupled to the body member 14 in frictional engagement therewith until or unless the body members 14 and 18 are purposefully separated from each other.

Similarly, the outer cross section of the wall of the upper pedestal 42 is also uniform throughout the longitudinal length of the pedestal 42. The outer surface of the sides of the pedestal 42 have the same shape as the mouth 36. The pedestal 42 thereby slides smoothly into the mouth 36 and remains snugly coupled thereto in frictional engagement therewith until such time as the body members 16 and 18 are purposefully separated from each other.

As best illustrated in FIGS. 2, 5, 6, and 8, a pair of writing implements, specifically a very short ink felt tip marking pen 48 and a very short lead pencil 50, are mounted to one of the first and second pedestals 40 and 42. The pair of writing implements 48 and 50 are located side by side and are both mounted in the same one of the pedestals of the third body component 18.

The writing implement 48 in the pair of writing implements 48 and 50 is a pen for marking golf balls, while the other writing implement in the pair is a pencil for filling in golf score cards. In the embodiment illustrated, the marking pen 48 and the pencil 50 are both mounted in the upper pedestal 42. A pair of longitudinally extending sockets 52 and 54, both having a cylindrical shape, are formed into the second pedestal 42 and are located in a side-by-side relationship to each other, in mutually parallel alignment. The marking pen 48 has a felt tip 56 that is mounted within a short, cylindrical barrel 58 that fits into the socket 52. The socket 52 seats and frictionally grips the outer cylindrical walls of the marking pen barrel 58.

Similarly, the lead pencil 50 is formed with a hard lead tip 60 that is mounted within a cylindrical barrel 62. The lead pencil barrel 62 has an outer diameter that fits snugly into the socket 54, which provides a seat for and frictionally grips the outer walls of the pencil barrel 62.

The pair of writing implements 48 and 50 are disposed side by side in mutually parallel alignment with each other. The writing implements 48 and 50 are respectively seated in the sockets 52 and 54. When the second body component element 16 is engaged with the third body component element 18, the golf ball marking pen 48 projects upwardly into the cylindrical, hollow cavity 34 in the second body component 16 while the lead marking pencil 50 projects upwardly into the hollow, cylindrical cavity 32, also defined in the structure of the second body component element 16, as depicted in FIG. 2.

Figure 6:
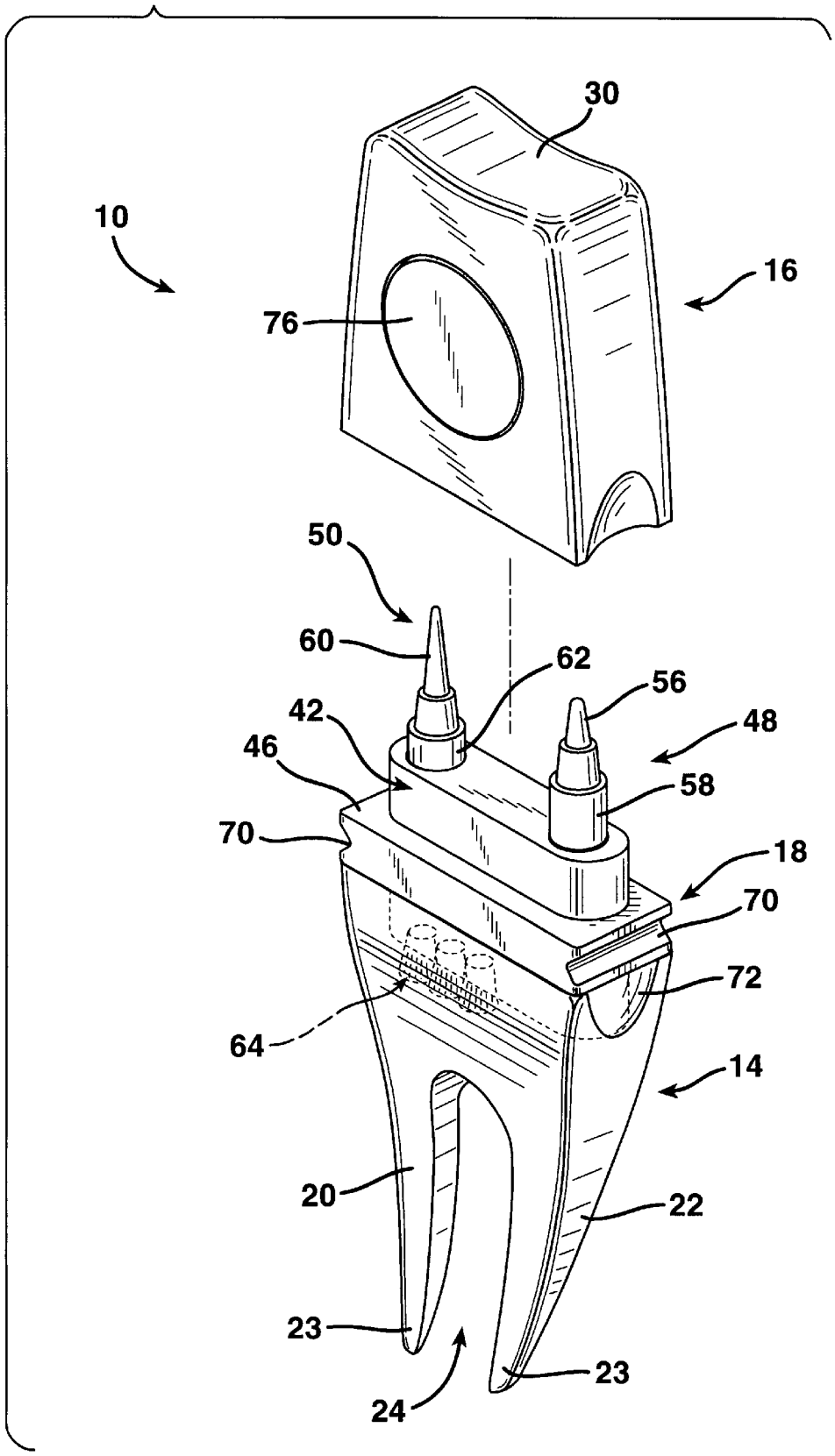
FIG. 6 is a front perspective view illustrating separation of selected body components to expose and provide access to the writing implements mounted in the tool of FIG. 1.
Figure 7:
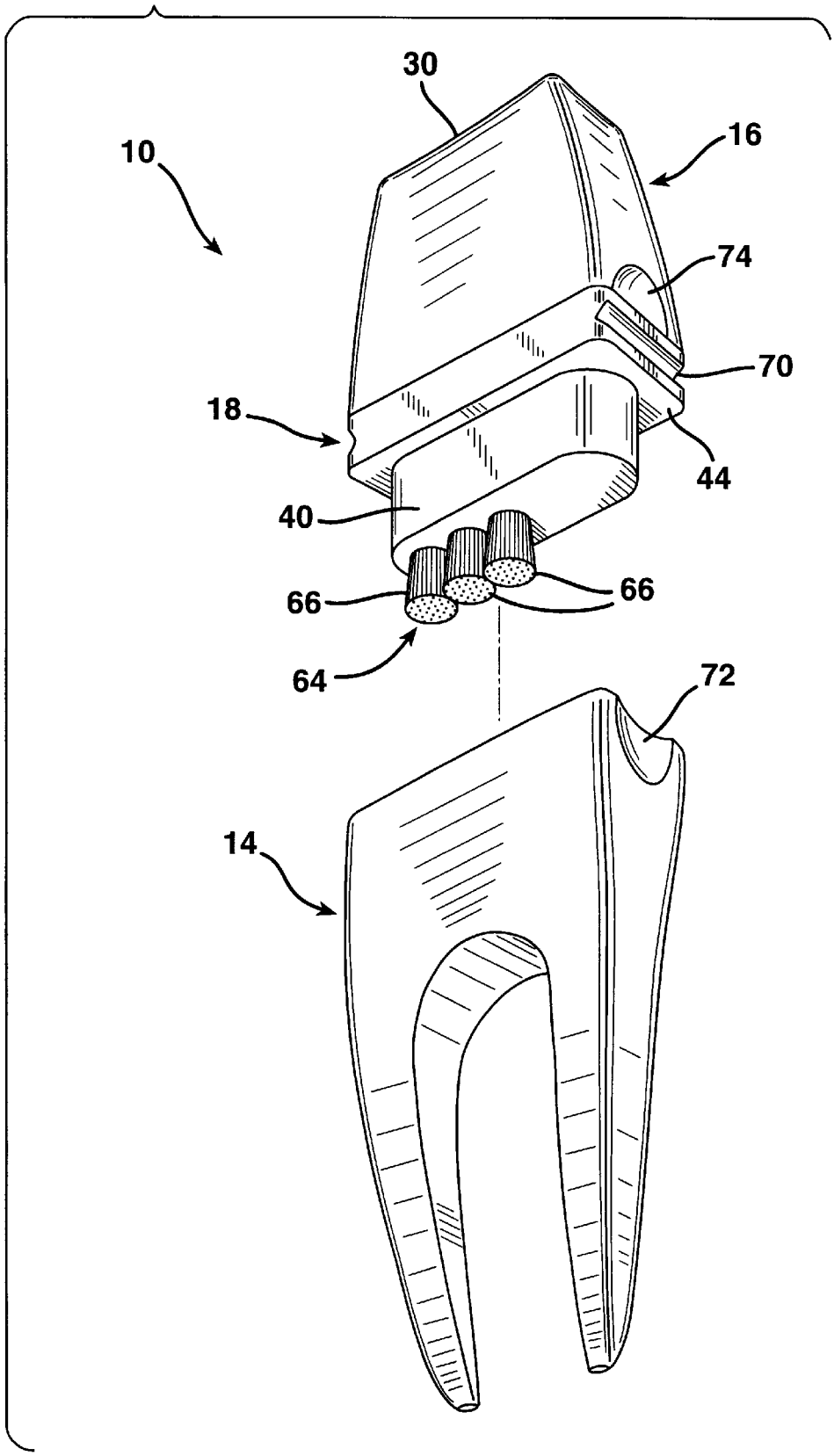
FIG. 7 is a rear perspective view of the tool of FIG. 1 showing selected separation of some of the body components to expose and provide access to the brush of the tool of the invention.

A brush 64 is mounted to the other pedestal of the third body component 18, specifically to the pedestal 40. The brush 64 is formed of three sets of bristles 66 having lower, exposed ends that extend downwardly in a direction opposite to the direction in which the writing implements 48 and 50 extend. The sets of bristles 66 also have upper ends which are permanently secured within three mutually parallel, longitudinally extending bristle sockets 68, as best illustrated in FIG. 2. A conventional adhesive is typically employed to ensure that the upper, entrapped ends of the bristle sets 66 remain permanently attached and mounted to the lower pedestal 40. When the first body component 14 and the third body component 18 are releasably engaged together, as illustrated in FIGS. 2 and 6, the brush 64 extends downwardly into the hollow cavity 28.

When all three of the body components 14, 16, and 18 are releasably engaged together, the pedestals 40 and 42 are frictionally engaged with the first and second body member 14 and 16, respectively. The writing implements 48 and 50 are enclosed within the hollow cavities 32 and 34 of the second body member 16, while the brush 64 is enclosed within the hollow cavity 28 of the first body member 14.

The first and second body component elements 14 and 16 have, respectively, open mouths 26 and 38 that lead to the cavity 28 in the lower body component 14 and the cavities 32 and 34 in the upper body component 16, respectively. The open mouths 26 and 36 frictionally engage the mounting pedestals 40 and 42 when all of the body components 14, 16, and 18 are assembled together, as illustrated in FIGS. 1–4.

The transverse ledges 44 and 46 surround the pedestals 40 and 42, respectively, and are both orientated at right angles relative to the pedestal sides. When all of the body components 14, 16, and 18 are assembled together so that the pedestals 40 and 42 are frictionally engaged in the mouths 26 and 36 of the first and second body members 14 and 16, respectively, the mouths 26 and 36 reside in abutment against the transverse ledges 44 and 46, respectively. The mouths 26 and 36 thereby reside in abutment against the central base 38 when the first and second component base elements 14 and 16 are respectively engaged with the opposite ends of the third component base element 18.

As illustrated in the drawings, the base 38 of the third body component 18 has opposing sides. A pair of V-shaped fingernail grip indentations 70 are defined in the opposite sides of the base 38. The first and second body component elements 14 and 16 also have opposite sides which are disposed adjacent the base 38 when the first and second body component elements 14 and 16 are engaged with the opposite ends of the third body component element 18. Concave surfaces or depressions 72 are formed into the opposing sides of the upper end of the first body component element 14. Similarly, mirror image concave surfaces or depressions 74 are formed into the opposing sides of the lower end of the second body component element 16. The depressions 72 and 74 are formed to receive the tips of the digits of a golfer's hand, namely the tips of the golfer's fingers or thumbs.

The golf surface repair tool 10 also includes a small, flat, thin disc-shaped golf ball marker 76, formed of iron or steel. A disc-shaped central cavity or recess 78 is formed in the front face of the second body component 16. The recess 78 has a circular perimeter and may, for example, be about one-half of an inch in diameter. A slab of magnetic material 80 is secured in the recess 78 in the front face of the tool body component 16. The magnetic material 80 is formed of a sheet or slab of rubber in which magnetized iron or iron oxide particles are embedded. The magnetic slab 80 is shaped in the form of a circular disc with a segment removed beneath its lower straight edge 82 which extends as a cord below the center of the disc-shaped recess 78. The magnetic slab 80 thereby occupies less than the entire peripheral area of the recessed region 78, thus leaving an unfilled cavity at the lower periphery of the recessed region 78.

The magnetic slab 80 is preferably only about one millimeter in thickness and is secured by an adhesive to the floor of the recessed area 78 in the outer surface of the second body component element 16. The depth of the recessed area is great enough so that there is sufficient room within the recessed region 78 to receive the disc-shaped ball marker 76 atop the magnetic slap 80. While the ball marker 76 has been illustrated as an unadorned disc, more typically it will bear some decoration or ornamentation, such as the logo of a country club or golf tournament, a golf organization, the golfer's business, or some other indicia of an organization or design.

Figure 9:
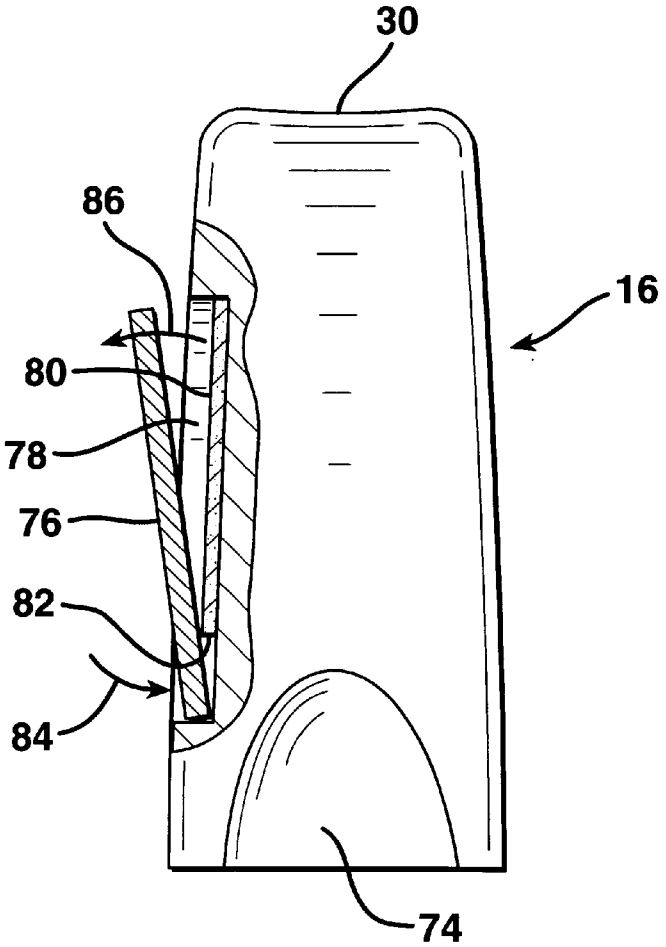
FIG. 9 illustrates the manner in which the golf ball marker is removed from its seat in the golf surface repair tool of FIG. 1.
Figure 8:
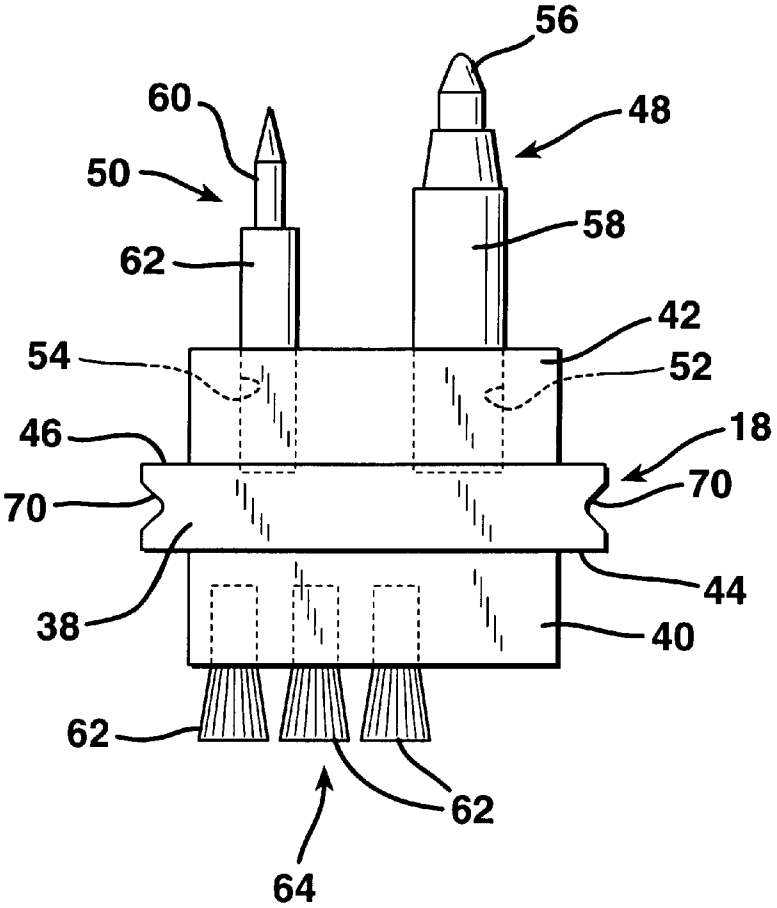
FIG. 8 is a front elevational view of the body component of the invention that carries the writing implements and the brush, shown in isolation.

When the golf ball marker 76 is seated within the confines of the recessed region 78, as depicted in FIG. 6, for example, it may be dislodged by applying pressure inwardly toward the body 12 of the golf surface repair tool 10 near the lower peripheral area of its exposed surface, as indicated by the directional arrow 84 in FIG. 9. The force exerted is slight but must be sufficient to overcome the force of magnetic attraction between the magnetic slab 80 and the ball marker 76. Pressure against the ball marker 76 at the region thereof located atop the cavity beneath the magnetic slab 80 pivots the ball marker 76 about the lower edge 82 of the magnetic slab 80, thereby causing the upper portion of the ball marker 76 to tile away from the front surface of the second tool body component 16, as indicated by the directional arrow 86 in FIG. 9. The golfer can then grip the upper edge of the ball marker 76 between the thumb and forefinger of one hand, and remove it for placement on the playing surface.

The body component elements 14, 16, and 18 are normally releasably engaged together and the repair tool is normally carried by the golfer in the pocket of the golfer's slacks in the condition illustrated in FIGS. 1–4. In this condition, the tool 10 can be utilized to repair divots and repair the surface of a golf green following a put in the usual manner. That is, the tips of the legs 20 and 22 are inserted into the turf while the upper end 30 of the tool 10 is held in the golfer's hand. The tool 10 is then rotated rearwardly while bringing the distal tips 23 of the legs 20 and 22 forwardly and upwardly, as viewed with reference to FIG. 3. Also, the legs 20 and 22 may be inserted into the turf and the handle of a golf club may be laid onto the concave upper surface of the upper end 30 of the second body element 16 to keep the grip of the handle off of wet grass on the playing surface. The golf surface repair tool 10 thereby serves its conventional purpose when all of the body components are coupled together, as illustrated in FIGS. 1–4.

When the golfer decides to mark a ball utilizing the ball marking pen 48, or write a golf score, utilizing the lead pencil 50, however, it is necessary to separate the second body component 16 from the first and third body components 14 and 18, which remain coupled together as depicted in FIG. 6. This separation is achieved quite easily by placing the thumbnail of one hand into the V-shaped indentation 70 on one side of the base 38 of the third body component 18, while pressing against the base 38 from the opposite side utilizing the fingers of the same hand. At the same time, the golfer places the tip of his or her thumb in one of the recesses 74 so that tips of the golfer's two thumbs are located closely adjacent to each other and directed toward each other. The golfer then exerts a slight force which pulls the second body component element 16 with one hand while gripping the first and third body component elements 14 and 18 with the other. The grips provided by the indentations 70 and the depressions 74 facilitate this separation. The golfer is then able readily to withdraw the second body component 16 from the third body component 18 as illustrated in FIG. 6. This exposes both the ball marking pen 48 and the pencil 50 to allow the golfer to either mark a ball, write a golf score, or both. When the golfer is finished the second body component 16 is pressed back toward the third body component 18 so that the pedestal 42 slides smoothly into the mouth 26 of the second body component 16.

On the other hand, when the golfer wishes to expose and utilize the brush 64, the body components of the tool 10 are separated in a different manner. Specifically, to utilize the brush 64 the golfer inserts the thumbnail of one hand into the V-shaped indentation 70 while gripping the third body component 18 and the second body component 16 in the same hand. The golfer places the tip of the thumb of his or her opposite hand into the depression 72 immediately adjacent the thumb of the other hand that is in the indentation 70, while gripping the first body portion 14 with the fingers of the opposite hand. The golfer then pulls the body components apart so that the first body component 14 separates from the third body component 18 while the second and third body components 16 and 18 remain coupled together, in the manner depicted in FIG. 7. The golfer then utilizes the brush 64 to dislodge dirt or matted grass from the golfer's shoes. When finished, the golfer merely reconnects the third body component element 18 to the first body component element 14 by pressing the pedestal 40 back into the mouth 26. All of the body components 14, 16, and 18 are thereupon reconnected together, as depicted in FIGS. 1–4.

Undoubtedly, numerous variations and modifications of the invention will become readily apparent to those familiar with golf accessories. Specifically, different mounting arrangements for the writing implements and the brush could be adopted. For example, the brush 64 could be mounted in either the first body component element 14 or the second body element 16 so as to extend into an enclosure or cavity defined in the third body component element 18. The mounting arrangement for the writing implements 48 and 50 could likewise be reversed. Also, it is possible to construct the body component elements so that they are releasably coupled together by engageable detents, rather than by the force of friction. Other variations and modifications of the golf surface repair tool are also possible while remaining within the scope of the invention. Accordingly, the scope of the invention should not be construed as limited to the specific embodiment depicted and described.

I claim:

1. A golf surface repair tool having a body from which a pair of legs extend in side-by-side relationship wherein said body is comprised of at least three component elements which are releasably engageable together to define at least two enclosures therewithin and which are also separable from each other, and further comprising a writing implement and brush mounted within said body so as to fit into said at least two enclosures when said component elements are releasably engaged together, and said writing implement and said brush are selectively exposed for use when selected ones of said component elements are separated from each other.

2. A golf surface repair tool according to claim 1 in which said body includes first, second, and third component elements, and said legs project from said first component element and said enclosures are defined within said first and second component elements, and said writing implement and said brush are mounted to said third component element and project in opposite directions from each other.

3. A golf surface repair tool according to claim 2 wherein said third component element has opposite ends from which said writing implement and said brush respectively project, and said first and second component elements are engageable respectively with said opposite ends of said third component element.

4. A golf surface repair tool according to claim 3 wherein said third component element is formed with a central base and a pair of mounting pedestals projecting in opposite directions from said base at said opposite ends of said third component.

5. A golf surface repair tool according to claim 4 wherein said first and second component elements both have open mouths leading to said enclosures therewithin, and said open mouths of said first and second component elements frictionally engage said mounting pedestals and reside in abutment against said central base when said first and second component elements are engaged with said opposite ends of said third component element.

6. A golf surface repair tool according to claim 5 wherein said base has opposing sides and further comprising a pair of fingernail grip indentations defined on said opposite sides of said base.

7. A golf surface repair tool according to claim 6 wherein said first and second component elements have opposing sides which are disposed adjacent said base when said first and second component elements are engaged with said opposite ends of said third component element, and concave surfaces are formed into said opposing sides of both said first and second component elements to define depressions to receive the tips of the digits of a golfer's hand.

8. A golf surface repair tool according to claim 1 wherein a recessed region is defined in the outer surface of said second component element, and further comprising a flat, magnetic slab secured within said recessed region and a flat ball marker formed of a material attracted by magnetism removably disposed in said recessed region and held there by the magnetic force of said flat, magnetic slab.

9. A golf surface repair tool according to claim 1 further comprising a pair of writing implements as aforesaid, and one of said writing implements includes an ink marking pen and the other of said writing implements includes a pencil lead.

10. A golf surface repair tool formed of at least three body members and comprising:

a first body member having a pair of legs and an open mouth and defining a hollow cavity therewithin in open communication with its open mouth, a second body member having a closed end and an opposing open mouth and defining at least one hollow cavity in open communication with its open mouth, a third body member formed with a central base and first and second pedestals that project from said base in opposite directions from each other, and said pedestals have sides that respectively fit snugly in frictional engagement into said open mouths of said first and second body members, a writing implement mounted to one of said first and second pedestals and projecting away from said central base, a brush mounted to the other of said first and second pedestals and projecting away from said central base in a direction opposite said writing implement, whereby said brush and said writing implement are enclosed within said hollow cavities of said first and second body members when said pedestals of said third body member are frictionally engaged therewith.

11. A golf surface repair tool according to claim 10 further comprising a pair of writing implements as aforesaid disposed side by side and mounted to said one of said first and second pedestals, and a pair of sockets located side by side are formed into said one of said first and second pedestals, and said sockets seat and frictionally grip said pair of writing implements.

12. A golf surface repair tool according to claim 11 wherein said base defines a pair of transverse ledges that surround said first and second pedestals, and said mouths of said first and second body members reside in abutment against said transverse ledges when said pedestals are frictionally engaged in said open mouths of said first and second body members.

13. A golf surface repair tool according to claim 10 further comprising fingernail grip indentations formed in said central base of said third body member, and finger tip grip depressions formed in said first and second body members to facilitate separation of said body members from each other.

14. A golf surface repair tool according to claim 10 wherein said closed end of said second body member has a concave upper surface defined thereon to serve as a golf club shaft rest.

15. A golf surface repair tool according to claim 10 in which said legs are oriented side and have distal extremities that are arcuately curved.

16. A golf surface repair tool formed of a plurality of detachable and releasbly engageable body components comprising:

a first body component having one end at which a pair of legs that define a gap therebetween are formed and an opposite end that forms an open cavity within said first body component, a second body component having a closed end and an opposite end defining at least one open cavity therewithin, a third body component formed with a central base and a pair of pedestals projecting in opposite directions from said central base and said pedestals are smaller in cross-sectional area than said central base, thereby forming seating ledges beside both of said pedestals, at least one writing implement mounted in one of said pedestals and projecting outwardly therefrom away from said base, and a brush mounted in the other of said pedestals and having bristles projecting outwardly therefrom away from said base in a direction opposite said writing implement, and said first and second body components are releasably engageable with said third body component so that said opposite ends of said first and second body components reside in abutment against said seating ledges of said third body component, thereby closing said cavities, and said opposite ends of said first and second body components are engaged by friction with said pedestals so that said at least one writing implement and said brush project into and are housed within said cavities in respective ones of said first and second body components.

17. A golf surface repair tool according to claim 16 further comprising a pair of writing implements as aforesaid located side by side and mounted in the same one of said pedestals, and one of said writing implements in said pair is a marking pen and the other of said writing implements in said pair is a pencil.

18. A golf surface repair tool according to claim 16 further comprising grooves formed in the sides of said base to serve as fingernail grips and depressions formed in said first and second body components to serve as finger tip grips.

19. A golf surface repair tool according to claim 16 further comprising a golf ball marker seat defined in said second body component, a magnet located within said golf ball marker seat and permanently attached to said second body component, and a golf ball marker formed of a material attracted by magnetism and removably positionable in said golf ball marker seat.

* * * * *